US006443305B1

(12) United States Patent
Stanford et al.

(10) Patent No.: US 6,443,305 B1
(45) Date of Patent: Sep. 3, 2002

(54) SHAVER PACKAGING

(76) Inventors: Daniel Milan Stanford, 3/40 Woodvale Ave, North Epping, N.S.W. (AU), 2121; Clive Vincent Elliott, Wyoona, Lot 12, Blaxland Road, Little Hartly, N.S.W. (AU), 2790

( * ) Notice: Subject to any disclaimer, the term of this patent is extended or adjusted under 35 U.S.C. 154(b) by 76 days.

(21) Appl. No.: 09/680,841

(22) Filed: Oct. 6, 2000

(30) Foreign Application Priority Data

Sep. 21, 2000 (AU) ..... 61240/00

(51) Int. Cl.[7] ..... B65D 73/00

(52) U.S. Cl. ..... 206/461; 206/352; 206/776; 206/806

(58) Field of Search ..... 206/461, 462, 206/471, 352, 228, 775, 776, 806; 30/34.05, 74, 541

(56) References Cited

U.S. PATENT DOCUMENTS

| | | | | | |
|---|---|---|---|---|---|
| 3,463,308 | A | * | 8/1969 | Karl-Heinz Deneke | 206/461 |
| 4,341,306 | A | * | 7/1982 | Lightsey | 206/372 |
| 4,496,047 | A | * | 1/1985 | Gatley | 206/471 |
| 4,842,141 | A | * | 6/1989 | Segal | 206/462 |
| 5,407,066 | A | * | 4/1995 | Grange | 206/352 |
| 5,429,241 | A | * | 7/1995 | Althaus | 206/352 |

* cited by examiner

*Primary Examiner*—Luan K. Bui
(74) *Attorney, Agent, or Firm*—Harrison & Egbert

(57) ABSTRACT

A package for a shaver includes a display card made of non-magnetically conductive material. A pyramid-shaped housing extends from the display card and is also made of a non-magnetically conductive material. An aperture is provided to allow the insertion of a razor blade into the pyramid-shaped housing. A permanent magnet also resides within the housing. The packaging is believed to cooperate with and intensify the earth's magnetic field to prolong the useful life of the razor blade.

10 Claims, 2 Drawing Sheets

SHAVER PACKAGING

BACKGROUND OF THE INVENTION

The following invention relates to a package for a man's or a woman's shaver having a fixed razor blade. More particularly, though not exclusively, the invention relates to a package having a pyramid-shaped blade cover for a fixed-blade shaver.

As used herein, the phrase "fixed-blade shaver" and the phrase "fixed razor blade" and the like are intended to mean any non-electric shaver. For example, a fixed-blade shaver might have one or more blades mounted in a plastics moulding. The blade or blades might be spring-mounted in the moulding, rigidly mounted in the moulding or mounted so as to flex within the moulding.

DESCRIPTION OF RELATED ART

It is known to package fixed-blade shavers with replacement blades under a clear plastic bubble upon a cardboard backing. In such packaging, the handle of the handle sits upon the display face of the cardboard backing and the whole handle and blade fits within the contoured shape of the clear plastic cover together with the replacement blades.

It is believed that if a blade is housed within a small pyramid-shaped cover, then the blade will be affected so as to remain sharp for an indefinite period of time. By having the blade reside within a small pyramid-shaped cover during its transit and shelf-display time, it is believed that the blade would be sufficiently treated to last indefinitely and therefore replacement blades need not be used and therefore need not be provided with the initial purchase.

It is the object of the present invention to provide an alternate packaging structure for a fixed blade shaver.

There is disclosed herein a packaging structure for a fixed blade shaver, the structure including

- a backing/display card,
- a pyramid-shaped housing having a base contiguous with the card or as part of the card and an apex spaced from one side of the card,
- an aperture in the housing, and
- a shaver having a blade portion within the housing and a handle portion alongside the backing/display card, wherein part of the shaver extends through said aperture.

Preferably the aperture is in the base of the housing and through the card.

Preferably the handle of the shaver resides against the other side of the card.

Preferably the packaging is shrink-wrapped in see-through plastic material.

Preferably there is provided within the housing a permanent magnet in close proximity to the blade of the shaver.

Preferably the housing is made of non-magnetic and non-conductive material such as cardboard, paper or plastics.

Preferably the magnet adheres to an inner surface of the housing.

Preferably the base of the housing is square.

Preferably the card has a hanging aperture spaced from the housing by which the packaging structure can be suspended for display purposes.

Preferably the base of the pyramid-shaped housing is square and has its edges $\pi/2$ times the perpendicular distance from one side of the card to the apex.

BRIEF DESCRIPTION OF THE SEVERAL VIEWS OF THE DRAWINGS

A preferred form of the present invention will now be described by way of example with reference to the accompanying drawings.

DETAILED DESCRIPTION OF THE INVENTION

Figure 1:
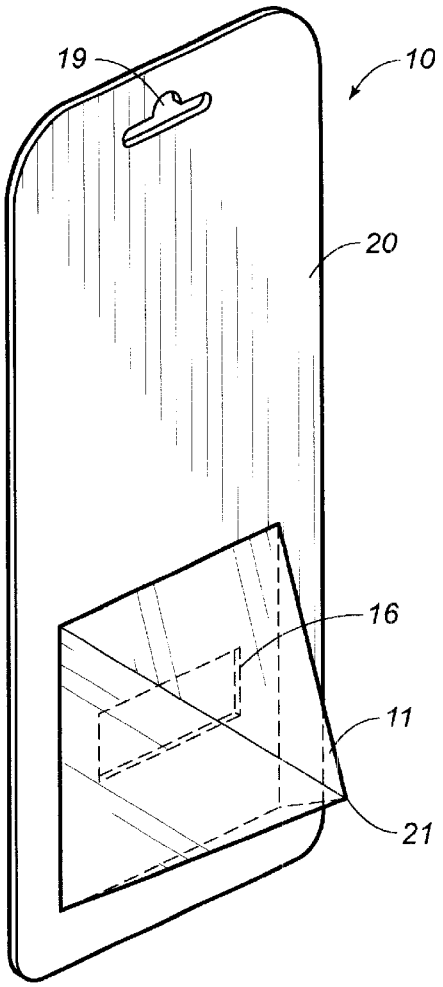
FIG. 1 is a schematic perspective view of a package for a shaver.
Figure 2:
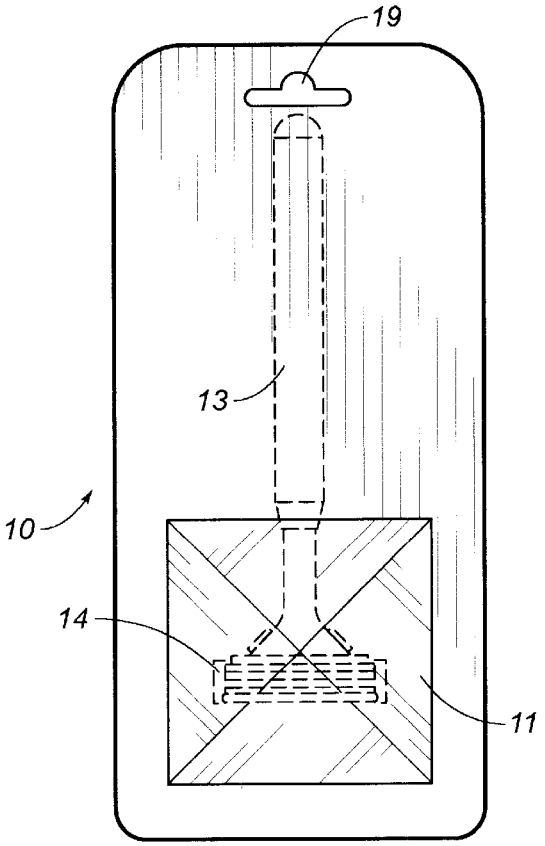
FIG. 2 is a schematic plan view of the package of FIG. 1 with the shaver shown in phantom.
Figure 3:
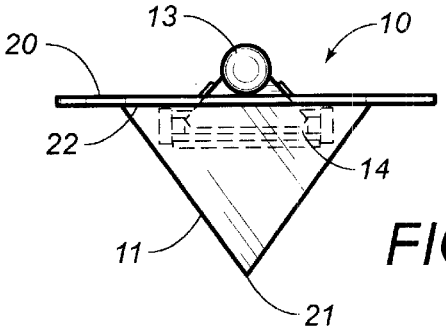
FIG. 3 is a schematic end elevational view of the package of FIG. 1 with the shaver shown in phantom.
Figure 4:
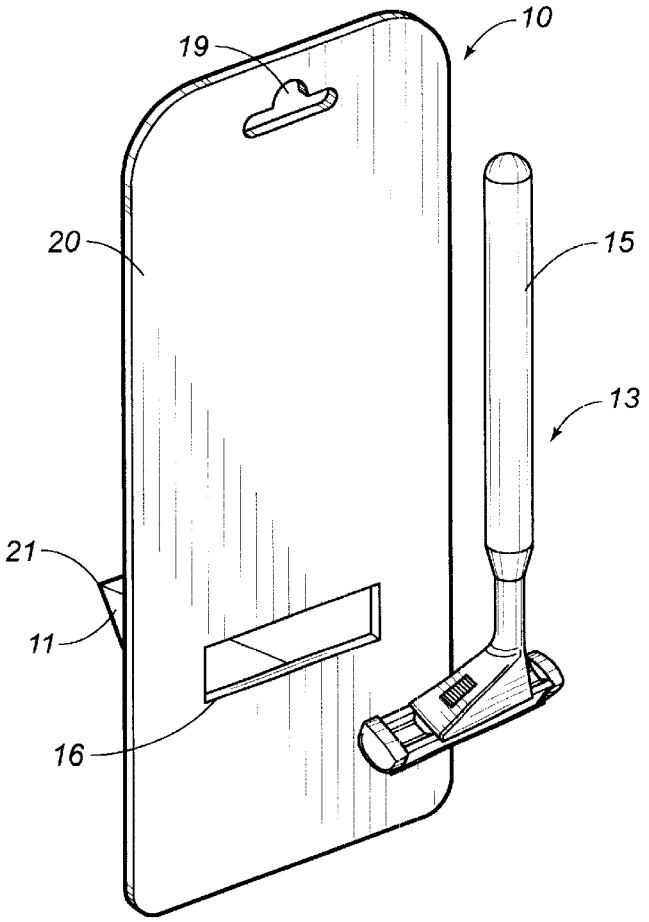
FIG. 4 is a schematic perspective view of the back of the package of FIG. 1 and a shaver to be packaged thereby.

In the accompanying drawings there is schematically depicted a package 10 for a fixed-blade shaver 13. The package 10 includes a base card or display card 20 made of cardboard, paper, plastics or other non-magnetically and non-magnetic material and having formed integrally therewith or attached thereto by glue or fasteners a pyramid-shaped housing 11 also made of non-magnetic and non-conductive material. The pyramid-shaped housing has its base 22 contiguous with or as part of the base card 20 and an apex 21 spaced from the card 20. Both the housing 11 and base card 20 are typically formed of cardboard and would have the trademark of the shaver product and other matter printed thereon.

Figure 5:
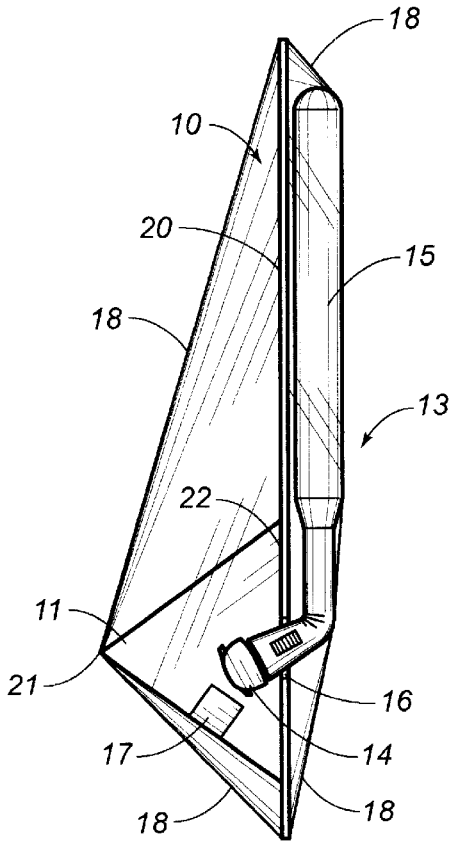
FIG. 5 is a schematic cross-sectional side elevational view of the package of FIG. 1 having a shaver packaged thereby.

The base 22 of the housing 11 has an aperture 16 therethrough as depicted. The shaver 13 includes a handle portion 15 which resides alongside the back face of the base card 20 and a blade portion 14 residing within the pyramid-shaped housing 11. Also within the pyramid-shaped housing 11 there is adhered to one of the inner surfaces a permanent magnet 17 (FIG. 5). The position of the magnet 17 with respect to the blade within blade portion 14 of the shaver is to place the blade portion within its magnetic field.

Both sides of the base card 20 and the housing 11 can be housed within a clear plastic cover 18 (FIG. 5). At one end of the base card 20 there is provided a hanging aperture 19 by which the package 10 can be suspended from a display bar with other packages for sale purposes.

It is believed that during the transit and display time of the package 10, the blade will be sufficiently treated by the effects of the Earth's magnetic field, the pyramid and the magnet to a degree sufficient to render the blade sharp and therefore useful for an indefinite period of time.

It is preferred that the pyramid has a square base and four sides with four triangular surfaces meeting at the apex. The length of each side of the base is to be the height of the pyramid (ie. the distance between the apex and the base measured perpendicularly from the base) multiplied by $\pi/2$. For example, if the pyramid is 4 cm high, the sides of the square base are approximately 6.28 cm. The length of each side of the pyramid (as measured from a corner of the base to the apex) is approximately 5.98 cm.

A new razor, either by itself or attached to a shaving handle, is inserted through the back of the pyramid in such a way as to be in the center of the pyramid and square to the base. The sharp edge of the razor should be in the center of the pyramid and parallel with two sides of the base. Also inserted into the pyramid is the tiny magnet (17), which can be on either side of the razor.

The pyramid can then be placed in such a way that each side of the base will face either north, south, east or west with the sharp edge of the razor facing east or west.

The razor stored in this way is exposed to the earth's magnetic field and is in line with that magnetic field. It is believed that continuous exposure of this field for more than one week and the presence of the magnet which intensifies the field, will make any razor last at least three months longer than it would otherwise last, depending of the quality of the razor. It is believed that longer exposures will significantly prolong the life of any razor for up to one year and even more.

It is known that a sharp edge is a formation of fine crystals and as long as their molecular structure is not disturbed, the edge remains sharp. It is believed that the invention works on the principle that a continuous exposure to the magnetic field of the earth, created by the pyramid and intensified by the inclusion of a small magnet, will increase the strength of the crystalline composition of the sharp edge of the razor to such an extent as to withstand multiple uses without disturbing this fine crystal structure and even to repair itself to a certain degree, thus lasting much longer.

What is claimed is:

1. A packaging structure for a fixed-blade shaver comprising:

a backing/display card, a pyramid-shaped housing having a base contiguous with the card or as part of the card and an apex spaced from one side of the card, an aperture in the housing, and a shaver having a blade portion within the housing and a handle portion alongside the backing/display card, wherein part of the shaver extends through said aperture.

2. The packaging structure of claim 1 wherein said aperture is in the base of the housing and through the card.

3. The packaging structure of claim 1 wherein said handle portion of the shaver resides against an opposite side of the card.

4. The packaging structure of claim 1 wherein said card, said housing, said aperture and said shaver are shrink-wrapped in see-through plastics material.

5. The packaging structure of claim 1 wherein said housing further comprises a permanent magnet in close proximity to the blade of the shaver within said housing.

6. The packaging structure of claim 1 wherein the said housing is comprised of a magnetically non-conductive material such as cardboard, paper or plastics.

7. The packaging structure of claim 5 wherein said magnet adheres to an inner surface of the housing.

8. The packaging structure of claim 1 wherein said base of the housing is square.

9. The packaging structure of claim 1 wherein said card comprises a hanging aperture spaced from the housing by which the packaging structure can be suspended for display purposes.

10. The packaging structure of claim 1 wherein said base of the pyramid-shaped housing is square and has its edges $\pi/2$ times the perpendicular distance from said one side of the card to the apex.

* * * * *